US005744899A

United States Patent [19]

Lee et al.

[11] Patent Number: 5,744,899

[45] Date of Patent: Apr. 28, 1998

[54] ILLUMINATING LAMP WITH ENHANCED FAR INFRARED RADIATION

[76] Inventors: Haengwoo Lee, Karam 15-402, 986 Samcheon Dong, Seoku, Daejeon; Sookhee Kim, Lucky 910-103, Hoo Gok Village 1058, Ilsan Dong, Goyang, Kyoungki, both of Rep. of Korea

[21] Appl. No.: 417,336

[22] Filed: Apr. 5, 1995

[30] Foreign Application Priority Data

Jun. 9, 1994 [KR] Rep. of Korea ..... 1994/13179

[51] Int. Cl.[6] ..... H01J 5/16

[52] U.S. Cl. ..... 313/110; 313/318.07

[58] Field of Search ..... 313/110, 113, 313/318.6, 318.7, 242, 315, 578, 579; 362/293, 260; 250/504 R, 493.1; 359/350

[56] References Cited

U.S. PATENT DOCUMENTS

| | | | |
|---|---|---|---|
| 2,088,544 | 6/1937 | Braselton | 250/504 |
| 3,586,851 | 6/1971 | Rudolph | 362/293 |
| 5,098,700 | 3/1992 | Nakai et al. | 250/493.1 |
| 5,438,233 | 8/1995 | Boland et al. | 313/110 |
| 5,444,261 | 8/1995 | Kim | 250/493.1 |

*Primary Examiner*—Sandra L. O'Shea

*Assistant Examiner*—Vip Patel

*Attorney, Agent, or Firm*—Seidel, Gonda, Lavorgna & Monaco, PC

[57] ABSTRACT

An illumination lamp capable of emanating far infrared rays together with visible rays comprises a glass enclosure, a light-emitting element located in the glass enclosure for producing light as an electric current is supplied to the element, a support stem for hermetically sealing the glass enclosure and holding the light-emitting element in a spaced apart relationship with respect to the glass enclosure and a far infrared ray emanating body fixedly mounted on the support stem for emitting the far infrared rays.

11 Claims, 3 Drawing Sheets

ILLUMINATING LAMP WITH ENHANCED FAR INFRARED RADIATION

FIELD OF THE INVENTION

The present invention pertains, generally, to a lamp for illuminating the indoor and outdoor space, and, more particularly, to an illumination lamp adapted to produce far infrared rays salutary to the human body, together with visible rays for illumination purposes.

DESCRIPTION OF THE PRIOR ART

A conventional illumination lamp, such as an incandescent lamp, a fluorescent lamp or a halogen lamp is typically provided with a tubular or globular shaped glass body, and resistive heating element, e.g., tungsten filament, enclosed in the glass body, and a pair of lead wires each connected at one end to the opposite ends of the tungsten filament and at the other end exposed to the outside. As soon as electricity is fed to the tungsten filament through the lead wires, the tungsten filament becomes heated to incandescence, thus lighting the darkness along with the release of free electrons.

As is well known, the illumination lamp can intrinsically emanate visible rays and infrared rays among other things. The visible rays, which amount to approximately 10% of the total radiation, are used for the sake of illumination per se, while the infrared rays, accounting for 70% of the radiation, cannot be taken advantage of for the illumination at all. Specifically, the infrared rays emitted by a typical illumination lamp include near or medial infrared rays of relatively short wavelength, which have a vigorous thermal activity but exhibit an inferior permeability or transmittance. Due largely to this property, the near or medial infrared rays are almost all absorbed by the glass bulb and/or the lampshade in support of the glass bulb and get exhausted in the form of heat.

Efforts have been made to devise an illumination lamp of the type capable of creating far infrared rays which have a relatively long wavelength and, therefore, excellent permeability. Recent tests have shown that far infrared rays may have a beneficial effect on plants and agricultural life, such as increased growth rate. This may be attributable to the fact that far infrared rays have a similar natural frequency to that of naturally occurring organic compound molecules and, accordingly, the rays are highly susceptible of resonating with the organic compound molecules. There has also been some suggestions that far infrared rays may have a beneficial effect on some aspects of the human body. Furthermore, the far infrared rays serve to maintain foodstuffs fresh for a longer time by way of their sterilization and deodorization properties. Far infrared rays even play a role in purifying the atmospheric air by removal of impurities. This means that the far infrared rays are beneficial to the ecosystem in which human beings live.

One known technique of fabricating the illumination lamp which can produce the far infrared rays is to deposit a far infrared ray emanating substance on the inside or outside of the glass bulb such that the substance may be heated to produce the far infrared rays. A hardship is, however, encountered in coating the inside of the glass bulb with the far infrared ray emanating substance. This holds true in cases where the external surface of the glass bulb is subjected to the coating treatment. Namely, it is quite toilsome to evenly deposit a coating solution on the bulb surface and to increase the bonding strength to an acceptable degree. Insufficient bonding strength may lead to premature detachment or peeling off of the coating layer by virtue of the intense thermal energy emitted from the lamp. Sometimes, the coating layer becomes too heavily aged to produce the far infrared rays in an efficient manner. Moreover, in the event that the coating layer has no sufficient permeability for the visible rays, decrease in illuminance to a significant extent is unavoidable.

SUMMARY OF THE INVENTION

Accordingly, it is an object of the invention to provide an illumination lamp which is easy to fabricate and capable of emanating far infrared rays for the full period of service time of the lamp without causing any appreciable decrease in illuminance.

With this object in view, the present invention provides an illumination lamp comprising a glass enclosure having a light projection surface, a light emitting element located in the glass enclosure to produce light, a support stem for hermetically sealing the glass enclosure and holding the light-emitting element in a spaced apart relationship with respect to the glass enclosure and a far infrared ray emanating body fixedly mounted on the support stem at a position deviated from the light project ion surface of the glass enclosure so as to emit far infrared rays. The far infrared ray emanating body may be either a solid preform shaped prior to mounting the emanating body onto the support stem or a mixture of far infrared ray emission powder and heat-resistant binder filled into a recess of the support stem and allowed to solidify therein.

BRIEF DESCRIPTION OF THE DRAWINGS

Other objects, features, and advantages of the invention will become apparent from a review of the following description of the preferred embodiment taken in conjunction with the accompanying drawings in which.

DETAILED DESCRIPTION OF THE PREFERRED EMBODIMENTS

Figure 1:
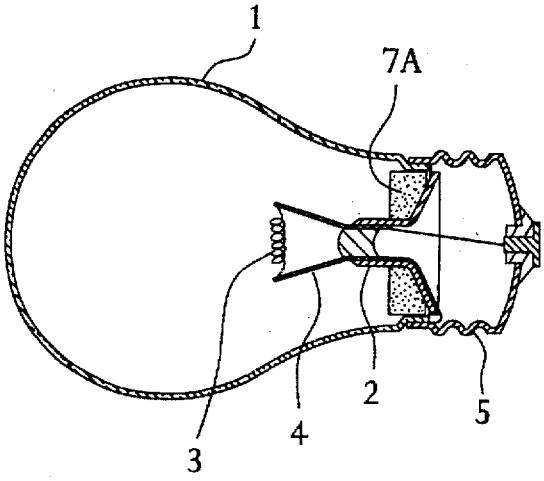
FIG. 1 is a cross-sectional view of an incandescent lamp in accordance with one embodiment of the invention, having a far infrared ray emanating body in the form of a solid preform.
Figure 2:
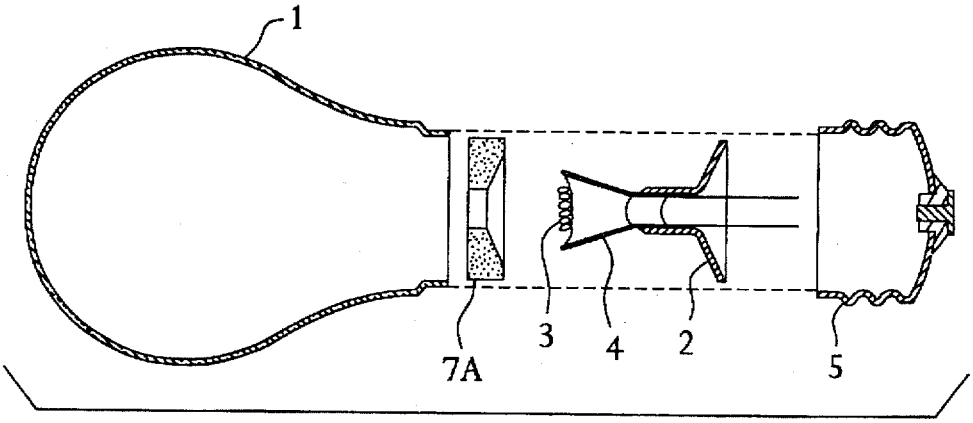
FIG. 2 is an exploded view showing the incandescent lamp of FIG. 1 in a disassembled state.

Referring now to FIGS. 1 and 2, it can be seen that the invention is embodied in an incandescent lamp by way of example. The incandescent lamp includes a glass bulb 1 which has a light projection surface terminating at an open neck and a screw base 5 which is affixed to the open neck. Interposed between the glass bulb 1 and the screw base 5 is a support stem 2 that serves to hermetically seal the glass bulb 1 and to hold a light-emitting element, e.g., tungsten filament 3, in a spaced apart relationship with respect to the glass bulb 1. The support stem also holds a pair of lead wires 4 through which the electricity is fed to the filament 3 to thereby have the latter produce light. A far infrared ray emanating body or substance 7A is fixedly mounted on the convex side of the support stem 2. To avoid any decrease in illuminance of the incandescent lamp, it is preferred that the far infrared ray emanating body 7A should remain deviated from the light projection surface of the glass bulb 1 so as not to obscure the visible ray projection path. For the purposes of simplicity the words "body" and "substance" will be used to refer to both the powdered and preformed embodiments of the far infrared emitting material.

The far infrared ray emanating body 7A can be preformed to closely fit on the convex side of the support stem 2 by using bioceramic or other like substance capable of emitting the far infrared rays. When assembling the incandescent lamp, the far infrared ray emanating body 7A is first fitted onto the support stem 2, the peripheral edge of which is then secured to the neck of the glass bulb 1 as by fusion bonding. Subsequently, the screw base 5 is adhesively bonded to the glass bulb 1 to form a finished lamp. If the incandescent lamp is supplied with electric current, the filament 3 begins to release free electrons which, in turn, hit against the far infrared ray emanating body 7A to trigger emission of the far infrared rays. As set forth at the outset, the far infrared rays assist in promoting metabolization of the living things and in repelling insects, e.g., mosquitos, away from the space illuminated by the lamp.

Figure 3A:
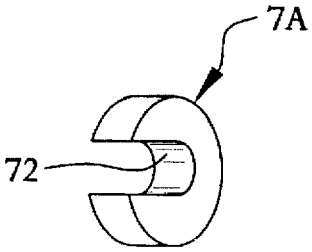
FIGS. 3A through 3C illustrate various forms of the far infrared ray emanating body suitable for the incandescent lamp.
Figure 3B:
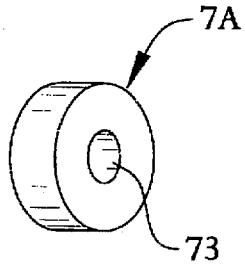
Figure 3C:
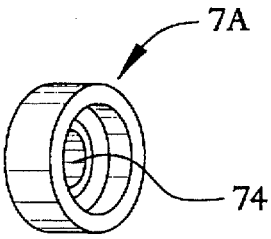

With reference to FIGS. 3A through 3C, there is shown by way of example three different shapes of the far infrared ray emanating body 7A. FIG. 3A shows that the far infrared ray emanating body 7A has a generally U-shaped axial groove 72 which may come into engagement with the support stem 2 as the emanating body 7A is pushed against the support stem 2 in the radial direction. FIG. 3B depicts another variant of the far infrared emanating body 7A having a central through-hole 73 through which the support stem 2 may be slidingly combined with the emanating body 7A before or after formation of the flare end of the support stem 2. FIG. 3C illustrates a further variant of the far infrared emanating body 7A having a tapering central aperture 74 which conforms to the flare end of the support stem 2.

Figure 4:
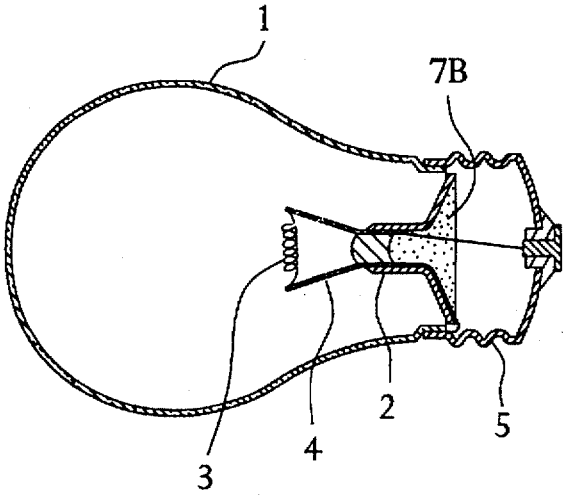
FIG. 4 shows another embodiment of the instant incandescent lamp having the far infrared ray emanating body filled in the recess of a support stem in powdery form and then allowed to solidify.

FIG. 4 shows an incandescent lamp in accordance with another embodiment of the invention wherein the far infrared ray emanating body 7B is positioned in the recess of the support stem 2. To form the emanating body 7B, a mixture of powdery far infrared ray emission substance and heat-resistant binder is, preferably, placed in the recess of the support stem 2. The mixture is then allowed to solidify, resulting in a solid far infrared ray emanating body.

Figure 5:
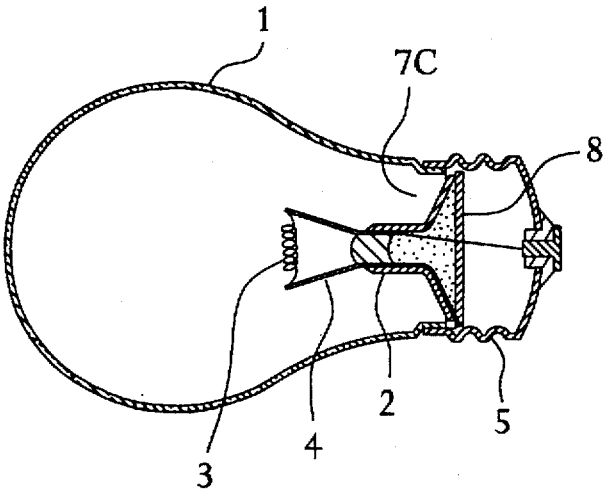
FIG. 5 is a view similar to FIG. 4 but showing a modification of the incandescent lamp which further includes a closure member positioned in front of the support stem recess.

FIG. 5 shows an incandescent lamp in accordance with a further embodiment of the invention wherein the far infrared ray emanating body 7C is formed by way of filling a mixture of powdery far infrared ray emission substance and heat-resistant binder in the recess of the support stem 2 and allowing the mixture to solidify. A closure member 8 is provided in front of the support stem recess to hold the mixture during and after its curing process. Alternatively, the infrared ray emission substance may be sealed within the recess without the use of a binder.

Figure 6:
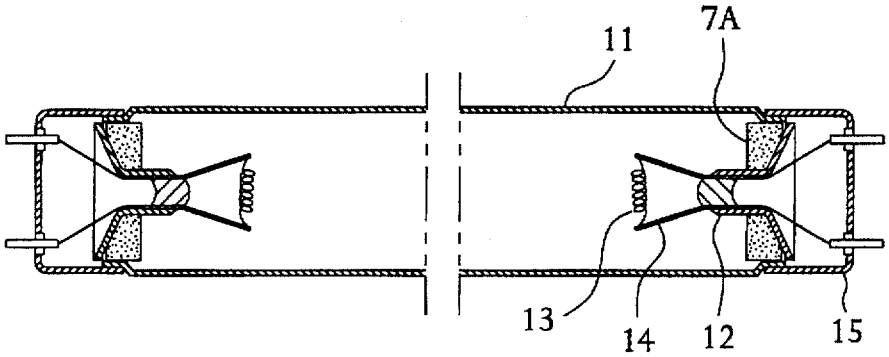
FIG. 6 shows a fluorescent lamp in accordance with a further embodiment of the invention, having a far infrared ray emanating body in the form of a solid preform.

Turning to FIG. 6, there is illustrated a fluorescent lamp embodying the invention in a similar way to the incandescent lamp described earlier in connection with FIGS. 1 and 2. The fluorescent lamp includes a glass tube 11 which has a light projection surface extending between the opposite ends of the glass tube 11. Fixedly attached to each end of the glass tube 11 is a support stem 12 which in turn holds a filament 13 in a spaced apart relationship with respect to the glass tube 11. A pair of lead wires 14 are connected to the filament 13 so as to supply electric current thereto. Also attached to the glass tube 11 is a cup-like base 15 that has a couple of parallel conductor pins. A far infrared ray emanating body 7A is mounted on the convex side of the support stem 12. As the filament 13 is supplied with the electric current, free electrons are released therefrom to cause the emanating body 7A to emit the far infrared rays.

Figure 7:
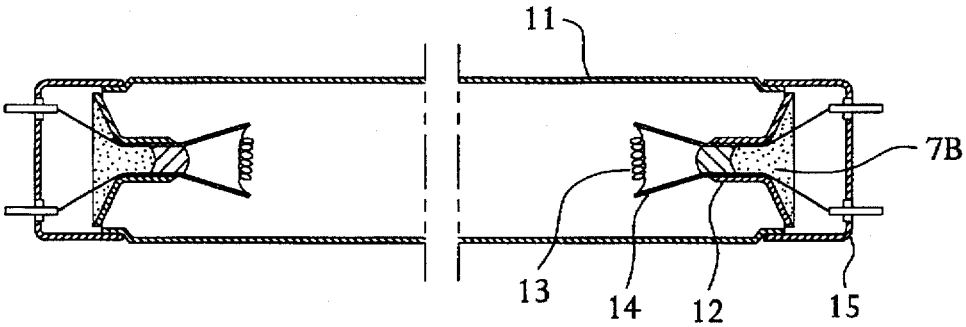
FIG. 7 shows a still further embodiment of the inventive fluorescent lamp with the far infrared ray emanating body filled in the recess of a support stem in powdery form and then allowed to solidify.

FIG. 7 shows a fluorescent lamp in accordance with a still further embodiment of the invention, wherein the far infrared ray emanating body 7B is constructed by way of filling a mixture of far infrared ray emission substance and heat-resistant binder in the recess of the support stem 12 and allowing the mixture to solidify.

Figure 8:
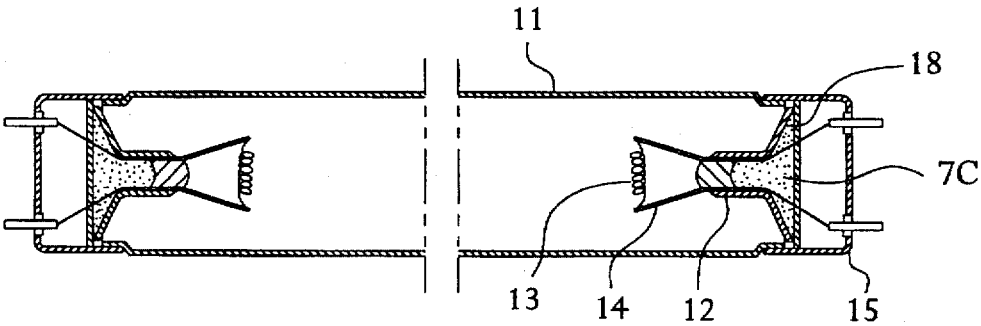
FIG. 8 is a view similar to FIG. 7 but showing a modification of the fluorescent lamp which further includes a closure member lying in front of the support stem recess.

FIG. 8 depicts a fluorescent lamp in accordance with yet a still further embodiment of the invention, which employs a closure member 18 positioned in front of the support stem recess to hold a mixture of far infrared ray emission substance and heat-resistant binder as it is cured into a far infrared ray emanating body 7C. Throughout FIGS. 6 to 8, like parts or components are designated by like reference numerals.

The illumination lamps constructed in the way set forth above offer the following advantages, while keeping the illuminance at satisfactory level. Firstly, the living environment can be kept pleasant since the far infrared rays serve to drive away vermin, such as mosquitos, for instance. Secondly, the far infrared rays emitted by the inventive illumination lamp may be advantageously used to accelerate the growth rate of plants and agricultural vegetation. Lastly, there has been some suggestion that far infrared rays may provide some benefits to human beings.

A preferred bioceramic powder, which will emit far infrared rays, has the following chemical composition:

| Composition | Percent |
|---|---|
| $SiO_2$ | 71.39 |
| $Al_2O_3$ | 14.47 |
| $Fe_2O_3$ | 3.45 |
| MgO | 0.69 |
| CaO | 1.48 |
| $Na_2O$ | 3.51 |
| $K_2O$ | 3.36 |
| $P_2O_5$ | 0.10 |
| Ti | 0.18 |
| Mn | 0.18 |
| Se | 0.17 |
| Ge | 80 ppm |

As discussed above, a binder, preferably heat-resistant, can be added to the bioceramic powder to produce a preform body which can then be attached to the support stem. Those skilled in the art would readily understand and appreciate the diverse methods of forming a preform within the scope of this invention.

While the invention has been shown and described with reference to preferred embodiments, it should be understood that many modifications, variations and changes may be made without departing from the spirit and scope of the invention as defined in the claims.

What is claimed is:

1. An illumination lamp emanating far infrared rays together with visible rays when an electric current is supplied to the lamp, the lamp comprising:

a glass enclosure;

a light-emitting element located in the glass enclosure for producing light when the electric current is supplied to the element;

a support stem for hermetically sealing the glass enclosure and holding the light-emitting element in a spaced apart relationship with respect to the glass enclosure;

at least one base attached to the glass enclosure which is adapted to engage with a light socket and which permits the transmission of the electric energy to the light-emitting element; and a far infrared ray emanating body mounted on the support stem for emitting far infrared rays, the far infrared ray emanating body being positioned between the light-emitting element and the base so as not to interfere with the passage of light through the glass enclosure, and wherein the far infrared ray emanating body comprises a mixture of far infrared ray emission substance and a heat resistant binder.

2. An illumination lamp emanating far infrared rays together with visible rays when electric current is supplied to the lamp, the lamp comprising:

a glass enclosure;

a light-emitting element located in the glass enclosure for producing the light when the electric current is supplied to the element;

a support stem for hermetically sealing the glass enclosure and holding light-emitting element in a spaced apart relationship with respect to the glass enclosure, the support stem furthermore having a recess;

at least one base attached to the glass enclosure which is adapted to engage with a light socket and which permits the transmission of the electric energy to the light-emitting element; and a far infrared ray emanating substance associated with the support stem for emitting far infrared rays, the far infrared ray emanating substance being positioned in the recess of the support stem and between the light-emitting element and the base so as not to interfere with the passage of light through the glass enclosure.

3. The illumination lamp as recited in claim 2, wherein the far infrared ray emanating substance comprises a powdered far infrared ray emission substance.

4. The illumination lamp as recited in claim 2, wherein the far infrared ray emanating substance comprises a mixture of far infrared ray emission substance and a heat resistant binder.

5. An illumination lamp emanating far infrared rays together with visible rays when electric current is supplied to the lamp, the lamp comprising:

a glass enclosure;

a light-emitting element disposed within the glass enclosure for producing light when electric current is supplied to the element;

a support stem for hermetically sealing the glass enclosure and for holding the light-emitting element in a spaced-apart relationship with respect to the glass enclosure; and a far infrared ray emanating body, the emanating body being a preform associated with the support stem.

6. The illumination lamp as recited in claim 5, wherein the far infrared ray emanating preform is attached to a convex surface of the support stem.

7. The illumination lamp as recited in claim 5, wherein the far infrared ray emanating body is a substantially circular preform which is concentrically mounted on the support stem.

8. An illumination lamp emanating far infrared rays together with visible rays when electric current is supplied to the lamp, the lamp comprising:

a glass enclosure;

a light-emitting element disposed within the glass enclosure for producing light when electric current is supplied to the element;

a support stem for hermetically sealing the glass enclosure and for holding the light-emitting element in a spaced-apart relationship with respect to the glass enclosure, the support stem having a recess; and a far infrared ray emanating body disposed within the recess of the support stem.

9. The illumination lamp as recited in claim 8, further comprising a closure member adapted to close off the recess of the support stem.

10. The illumination lamp as recited in claim 8, wherein the far infrared ray emanating body is a powdered far infrared ray emission substance.

11. The illumination lamp as recited in claim 8, wherein the far infrared ray emanating body is a mixture of far infrared ray emission substance and heat-resistant binder.

* * * * *